US009551193B2

(12) United States Patent
Cheeseman et al.

(10) Patent No.: US 9,551,193 B2
(45) Date of Patent: Jan. 24, 2017

(54) DRILL PIPE HANDLING APPARATUS HAVING IMPROVED PIPE GRIPPING MECHANISM

(71) Applicant: Schramm, Inc., West Chester, PA (US)

(72) Inventors: Chris Cheeseman, East Norriton, PA (US); Paul T. DiZillo, Coatesville, PA (US); David Y. Sim, Media, PA (US)

(73) Assignee: Schramm, Inc., West Chester, PA (US)

( * ) Notice: Subject to any disclaimer, the term of this patent is extended or adjusted under 35 U.S.C. 154(b) by 386 days.

(21) Appl. No.: 14/224,912

(22) Filed: Mar. 25, 2014

(65) Prior Publication Data

US 2015/0275595 A1 Oct. 1, 2015

(51) Int. Cl.
*E21B 19/15* (2006.01)

(52) U.S. Cl.
CPC ..... *E21B 19/15* (2013.01); *E21B 19/155* (2013.01)

(58) Field of Classification Search
CPC ..... E21B 19/15; E21B 19/155; B66C 1/427
USPC ..... 294/194, 198, 902; 414/22.54, 22.57, 414/22.58
See application file for complete search history.

(56) References Cited

U.S. PATENT DOCUMENTS 3,322,456 A * 5/1967 Strakhal ..... E21B 19/00 24/493
4,023,449 A 5/1977 Boyadjieff
4,082,017 A 4/1978 Eckel
4,326,435 A 4/1982 Guillot et al.
4,371,302 A * 2/1983 Frias ..... E21B 19/155 414/22.61
4,403,897 A * 9/1983 Willis ..... E21B 19/155 269/238
4,718,816 A * 1/1988 King ..... B66C 1/447 414/23
4,739,681 A 4/1988 Pietras
5,060,542 A 10/1991 Hauk
5,209,536 A * 5/1993 Rogers, Sr. ..... B66C 1/447 294/104
5,366,339 A * 11/1994 Gould ..... B66F 9/187 294/90
5,386,746 A 2/1995 Hauk
5,546,833 A 8/1996 Holdeman et al.
5,823,074 A 10/1998 Ahlstone
5,845,549 A 12/1998 Bouligny
5,868,045 A 2/1999 Hauk
6,270,136 B1 8/2001 Dagenais
6,311,788 B1 11/2001 Weixler
6,327,938 B1 12/2001 Pietras
6,814,149 B2 11/2004 Liess et al.
(Continued)

*Primary Examiner* — Dean Kramer
(74) *Attorney, Agent, or Firm* — Howson & Howson LLP

(57) ABSTRACT

In a drill pipe handling apparatus, a pipe gripping mechanism comprises three pipe-gripping jaws arranged to grip a pipe at locations adjacent the apices of a triangle containing the axis of the pipe. A first pipe gripping jaw is connectible to a first pivoted arm at any selected one of a set of plural distances from the pivot axis of the first arm and connected to the first arm at one of those plural distances, and a second jaw is connectible to the second arm at any selected one of the same set of plural distances from the pivot axis of the second arm and connected to the second arm at the same one of those plural distances at which the first jaw is connected to the first arm. Because the same first and second jaws are connectible to the arms at plural distances from the pivot axes, the same jaws can accommodate a wide range of pipe diameters.

8 Claims, 5 Drawing Sheets

(56) References Cited

U.S. PATENT DOCUMENTS

| | | | | |
|---|---|---|---|---|
| 7,062,991 | B1 | 6/2006 | West et al. | |
| 7,188,547 | B1 | 3/2007 | West et al. | |
| 7,313,986 | B2 | 1/2008 | West et al. | |
| 7,538,127 | B2 | 5/2009 | Biggadike et al. | |
| 8,042,432 | B2 | 10/2011 | Hunter et al. | |
| 8,146,971 | B2 | 4/2012 | LaValley et al. | |
| 8,281,867 | B2 | 10/2012 | Belik | |
| 8,413,728 | B2 | 4/2013 | Ledbetter et al. | |
| 8,474,806 | B2 * | 7/2013 | Orgeron | B25B 5/061 269/218 |
| 8,567,836 | B2 * | 10/2013 | LaValley | E21B 19/14 294/198 |
| 2013/0057007 | A1 * | 3/2013 | Howell | B65F 3/04 294/198 |

* cited by examiner

DRILL PIPE HANDLING APPARATUS HAVING IMPROVED PIPE GRIPPING MECHANISM

FIELD OF THE INVENTION

This invention relates to earth drilling, and particularly to a drill pipe handling apparatus for moving drill pipe. The invention has applicability, for example, in moving a drill pipe from a drill pipe storage rack to a drilling mast for connection to other drill pipes in order to form a drill string, and in returning drill pipes from the drilling mast to the storage rack.

BACKGROUND OF THE INVENTION

In earth drilling, for example the drilling of wells for extraction of water, oil, natural gas, or coal bed methane, and in drilling for other purposes such as mineral exploration, mining, access to geothermal energy, or the formation of holes for building foundations, etc., it is desirable for the drill pipe loading and unloading equipment used in conjunction with a drilling mast to be capable of handling drill pipe in a range of diameters. There are several reasons. First, the ability to accommodate a range of pipe diameters gives the drill pipe loading and unloading apparatus improved versatility. That is, it can handle pipe used to make up a small diameter drill string as well as pipe used to make up a large diameter drill string. Second, the loading and unloading apparatus can also be used in drilling boreholes where a borehole is first drilled using small bit and a narrow drill string and later expanded using a larger bit on a larger diameter drill string. Third, if well casing is to be installed, it is convenient to supply the well casing to the drilling mast using the same loading and unloading apparatus as was used to supply the drill pipe.

It has been common practice to use mechanical pipe gripping devices in these loading and unloading apparatuses to move lengths of drill pipe into position for attachment to the top head of a drilling mast. However, most such gripping devices have been capable of handling only a very limited range of drill pipe diameters. The use of replacement jaws has been proposed to enable a gripping apparatus to accommodate different pipe sizes. However, to achieve this objective, it is necessary to keep a supply of gripping jaws of various sizes on hand.

BRIEF SUMMARY OF THE INVENTION

In a preferred drill pipe handling apparatus according to this invention, a length of drill pipe is transferred from a supply rack onto an elongated V-shaped tray that is slidable longitudinally on an elongated support pivoted near one of its ends for tilting movement on an horizontal axis extending transverse to the direction of elongation of the support. Preferably, racks and pipe transfer devices are provided on both sides of the trough.

After a length of drill pipe is transferred onto the V-shaped tray, movement of the tray carries the length of pipe longitudinally until a part of the pipe is in register with a pipe gripping mechanism carried by the elongated support and positioned adjacent the end of the support opposite the pivoted end. The pipe gripping mechanism is also connected to the support by an actuator so that it is movable longitudinally relative to the support. The gripping mechanism is used to hold the length of drill pipe while it is being attached to, or removed from, the top head of the drilling mast.

The elongated pivoted support and actuator serve as a grip mechanism moving means, and cooperate to move the pipe gripping mechanism, and the movable tray moves the drill pipe into a position such that it can be clamped by the pipe gripping mechanism. The drill pipe can, of course, be fed to the gripping mechanism in other ways, and movement of the gripping mechanism so that the drill pipe clamped therein can be positioned for engagement with or disengagement from the top head of a drill mast, can likewise be effected in other ways.

The pipe gripping mechanism comprises a support frame connected to the moving means. First and second arms are connected to said support and movable relative to the support respectively about first and second pivot axes. A first actuator, connected to the first arm and the support, is provided for moving the first arm about the first pivot axis, and a second actuator, connected to the second arm and the support is provided for moving the second arm about the second pivot axis.

A first jaw, which is connectible to the first arm at any selected one of a set of plural distances from the first pivot axis, is connected to the first arm at one of those plural distances. A second jaw, which is similarly connectible to the second arm at any selected one of the same set of plural distances from the second pivot axis, is connected to the second arm at the same selected one of the set of plural distances.

A third jaw is also connected to the support frame. The first and second jaws are connected to the first and second arms at equal distances from the pivot axes of the respective arms, and the three jaws are positioned in relation to one another so that a cylindrical pipe within a range of pipe diameters can be gripped by contact, by said first, second and third jaws, with the exterior surface of said cylindrical pipe respectively at locations adjacent the three apices of a triangle containing the pipe axis. The ranges of pipe diameters are different for each of the plural distances. However, the ranges of pipe diameters accommodated by each of the plural distances can overlap.

The third jaw can be made movable along a line extending between the first and second jaws. The movability of the third jaw enables the gripping mechanism to handle not only straight cylindrical pipe and well casing, but also non-cylindrical pipe and upset pipe, i.e., pipe with large tool joints. The movable third jaw can be positioned so that, when the drill pipe is gripped, it is held in parallel relationship to the tray surface.

DETAILED DESCRIPTION OF THE PREFERRED EMBODIMENTS

Figure 1:
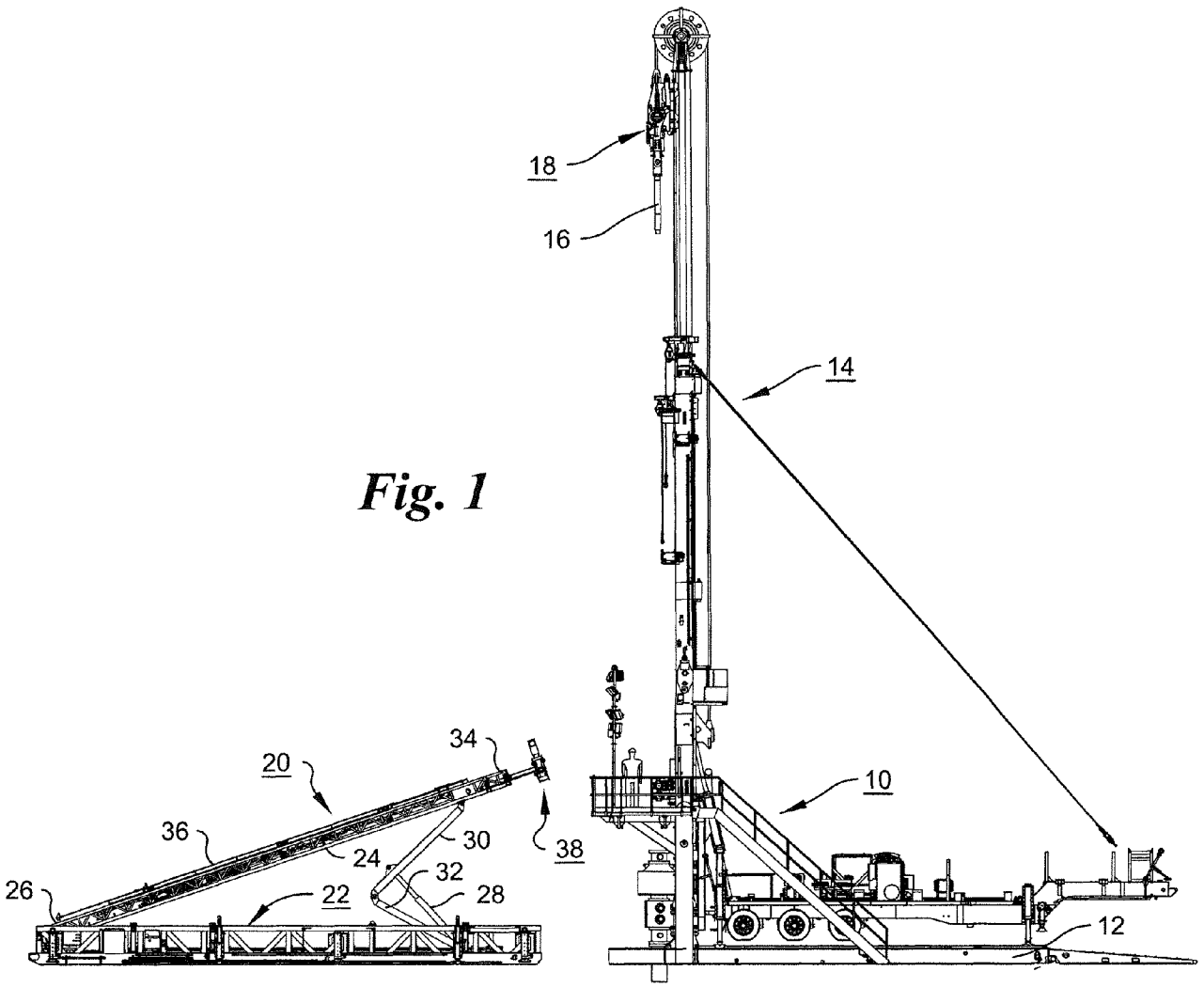
FIG. 1 is a side elevational view showing a pipe loader having a pipe gripping mechanism in accordance with the invention and a drilling mast served by the pipe loader.

As shown in FIG. 1, a mobile drilling rig 10 is supported on a platform 12, and includes a tiltable telescoping mast 14, which is shown in a vertical operating position. A length of drill pipe 16 is shown held by a vertically movable top head 18, used to control the weight applied to a drill bit by a drill string made up of a series of connected drill pipes. The top head is also used to position a drill pipe for connection to, or disconnection from, a drill string, and to withdraw the drill string from a bore hole.

Lengths of drill pipe are supplied to the top head by a pipe loader 20, which includes a base 22, and an elongated support 24, which is pivoted adjacent a first end 26 to a part of the base 20 remote from the drilling mast 14. A hydraulic actuator 28, connected to struts 30 of a hinged set of of struts 30 and 32, is used to raise and lower the opposite end 34 of the support 24. A pipe supporting tray 36 is mounted on the top side of the support 24, and longitudinally movable thereon by an actuator mechanism (not shown). A pipe gripping mechanism 38, mounted at end 34 of the support 24, is longitudinally movable relative to the support by another actuator mechanism (not shown).

Figure 2:
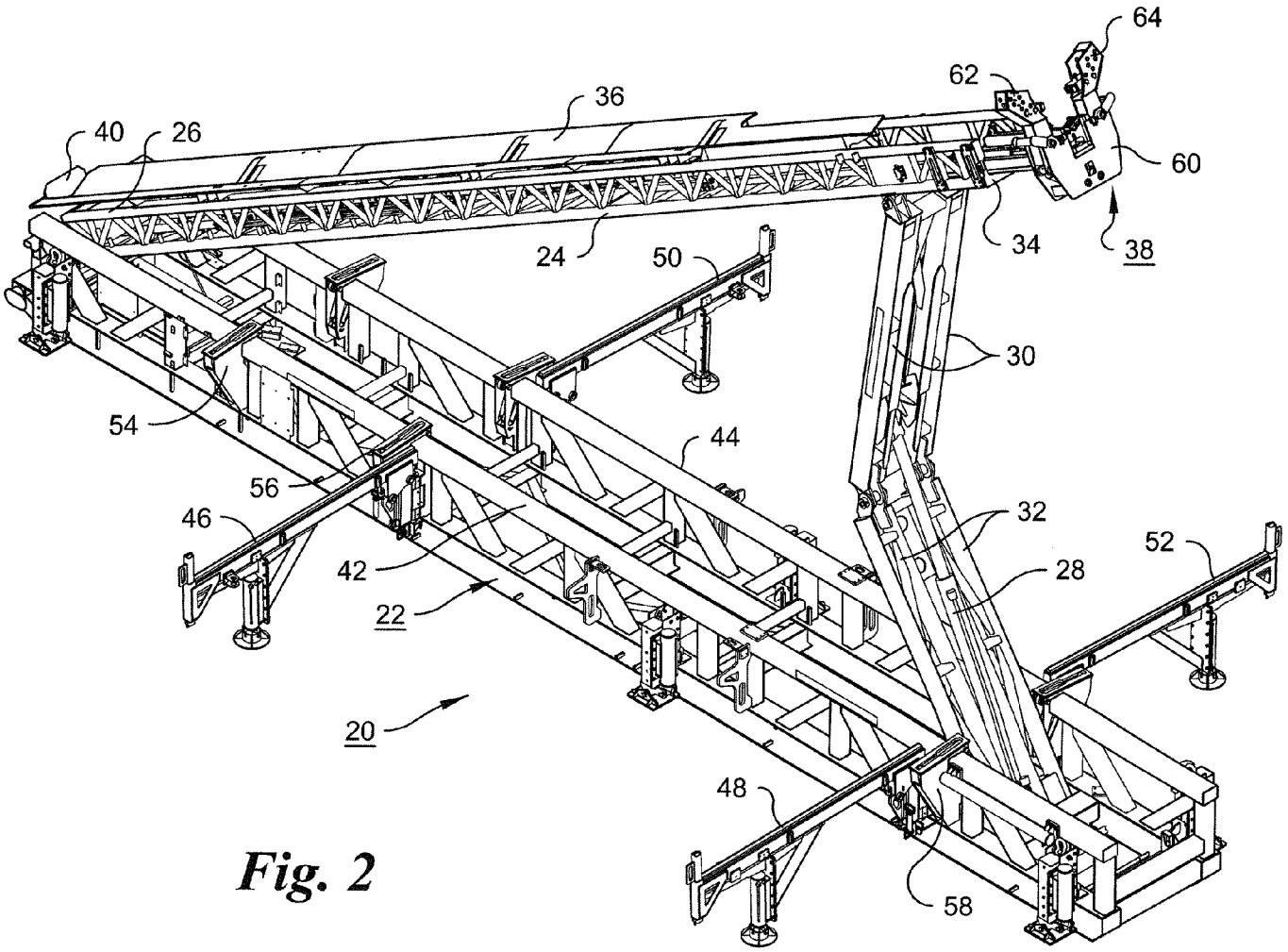
FIG. 2 is a perspective view of the pipe loader.

As seen in FIG. 2, the pipe supporting tray 36 is an elongated, V-shaped, tray arranged to slide longitudinally on the pivoted support 24. The tray includes an end panel 40 for engaging an end of a length of drill pipe held by the tray so that, when the tray is moved toward the gripping mechanism 38, the drill pipe is moved through the gripping mechanism.

The support 24 is movable by the actuator 28 into a horizontal position between side members 42 and 44 of the base, so that tray 36 is positioned to receive a length of drill pipe from a pipe rack located beside the base. In the embodiment shown, a first pipe rack, composed of rack members 46 and 48, is provided on one side of the base, and a second pipe rack, composed of rack members 50 and 52, is provided on the opposite side of the base. Pipe-engaging devices 54, 56 and 58 are used to move pipe from one of the racks onto the V-shaped tray, and a similar set of pipe-engaging devices is provided for the other rack.

As shown in FIG. 2, the pipe gripping mechanism 38, which includes a frame 60 and pivoted arms 62 and 64, is mounted on end 34 of the pivoted support 24, and is movable by an actuator (not shown) in the longitudinal direction of the support through a distance sufficient to enable the drill pipe to be attached to the top head, when the top head is lowered on the mast and tilted outward to receive the drill pipe.

To connect a length of drill pipe to the top head 18 of the drilling mast, the pivoted support 24 is first brought to its horizontal position between the side members of the base. Then, a length of drill pipe from one of the two racks is transferred to the V-shaped tray. With the pipe resting on the tray, the tray is moved forward until the front end of the pipe moves through the gripping mechanism 38. The gripping mechanism has clamping jaws, which are moved into gripping contact with the pipe. Longitudinal movement of the pipe can then be controlled by the actuator that moves the gripping mechanism. The support 24 is pivoted upward, and the top head 18 is lowered until it is located near the end of the pipe that protrudes from the gripping mechanism. The top head can then be tilted so that its spindle is aligned with the pipe, and by moving the gripping mechanism forward, the pipe can be engaged with the top head spindle. The gripping mechanism not only prevents the pipe from sliding down the tray when the support is raised, but also resists the torque applied to the pipe when the top head spindle is rotated to connect the pipe to the top head. Upon release of the pipe by the gripping mechanism, the pipe can be drawn upward by the top head, separated from the tray and from the gripping mechanism, and moved into a position in which it is parallel to the drilling mast. Then a bit can be attached to the drill pipe, or the drill pipe can be incorporated into a drill string composed of one or more other lengths of drill pipe.

Removal of a length of drill pipe from the drill string and return of the drill pipe to one of the racks is carried out by reversing the operations described above.

Figure 3:
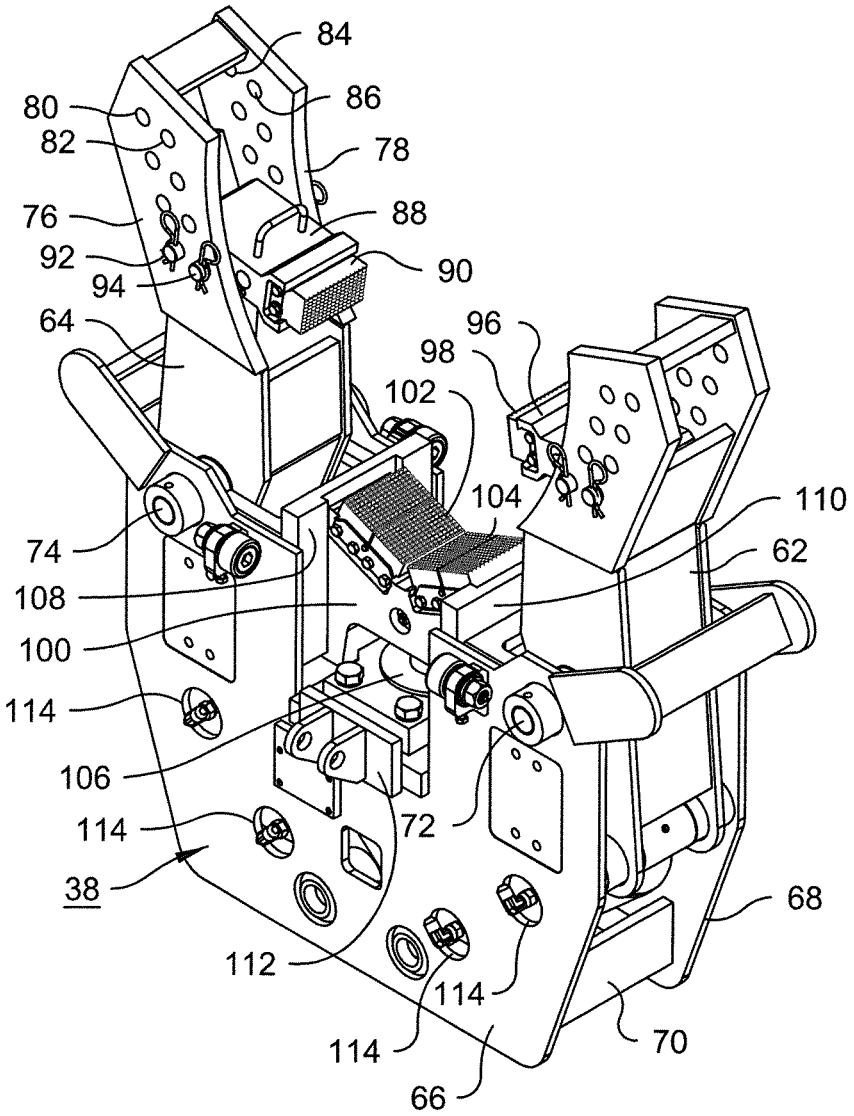
FIG. 3 is a perspective view of the pipe gripping mechanism.

As seen in FIG. 3 the frame 38 of the gripping mechanism comprises two plates, 66 and 68, which are held in parallel, spaced relationship to each other by connecting members, one of which is seen at 70. Arms 62 and 64 are respectively pivoted on shafts 72 and 74, which are secured to, and in perpendicular relation to, the plates. Pivoting movement of the arms is controlled by hydraulic actuators which are located between the plates and which will be described with reference to FIGS. 4 and 5.

Extending upward from the upper end of arm 64 are two spaced plates 76 and 78, parallel to each other and to plates 66 and 68. Each of plates 76 and 78 has four pairs of holes, each pair being disposed at a different distance from the pivot axis of the arm from which the plate extends. For example, plate 76 has an uppermost pair of holes 80 and 82, and plate 78 has a corresponding uppermost pair of holes 84 and 86, hole 84 being aligned with hole 80, and hole 86 being aligned with hole 82. In FIG. 3, a jaw holder 88, having a replaceable pipe-engaging jaw 90, is mounted between plates 76 and 78 by a pair of cylindrical pins 92 and 94, extending through the lowermost pairs of holes in plates 76 and 78 and through holes through the jaw holder. The cylindrical pins are removable, and secured in place by cotter pins. Arm 62 has a similarly mounted jaw holder 96 and jaw 98.

A third jaw holder 100, having a centering jaw composed of a pair of pipe engaging jaw elements 102 and 104 disposed with their pipe engaging faces in a V-shaped configuration, is mounted for vertical movement under the control of a hydraulic actuator 106 between a pair of guides 108 and 110. The gripping mechanism frame is provided with a connector 112 having two ears, and a set of elbow connectors 114 for connection to an actuator and a guide assembly at the end 34 (FIGS. 1 and 2) of the support 24.

Figure 4:
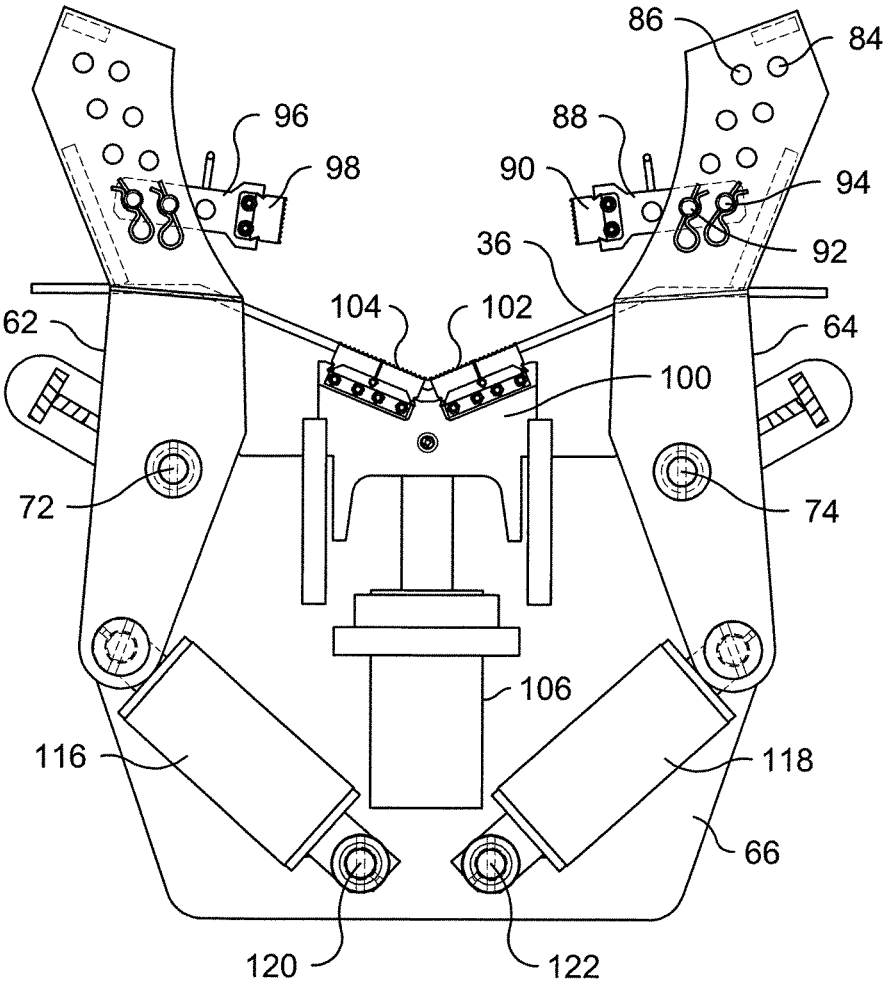
FIG. 4 is an elevational view of the pipe gripping mechanism, with the front plate 68 removed, showing the pivoted arms in an open condition.

As shown in FIG. 4, the lower ends of arm 62 is connected by a pivoting connection to the piston of a hydraulic actuator 116 and the lower end of arm 64 is similarly connected to the piston of a hydraulic actuator 118. Extensions of the cylinders of the hydraulic actuators are pivotably mounted on shafts 120 and 122, which extend from one of the plates of the frame to the other. Actuators 116 and 118 can cause the arms to rotate about shafts 72 and 74 so that the jaws can be brought toward each other and toward the centering jaw.

As shown in FIG. 4, the pipe engaging faces of the jaw elements 102 and 104 of the centering jaw are disposed in a V-shaped configuration, and at an angle corresponding to the angle of the central parts of the V-shaped pipe tray 36. The actuator 106 can move the pipe-engaging faces of the centering jaw to positions above, below, or in alignment with the tray 36. The movability of the centering jaw allows the gripping mechanism not only to handle straight cylindrical drill pipes and well casing, but also to accommodate upset pipe, e.g., non-cylindrical drill pipes having enlarged tool joints that, by engagement with the tray 36, cause the part of the pipe that extends though the gripping mechanism to be raised, and therefore positioned either above and parallel to the tray surface or out of parallel relation to the tray surface. The centering jaw can also enable the gripping mechanism to grip an enlarged tool joint or other enlargement on a pipe while maintaining the remainder of the pipe in parallel relation to the surface of the tray.

Figure 5:
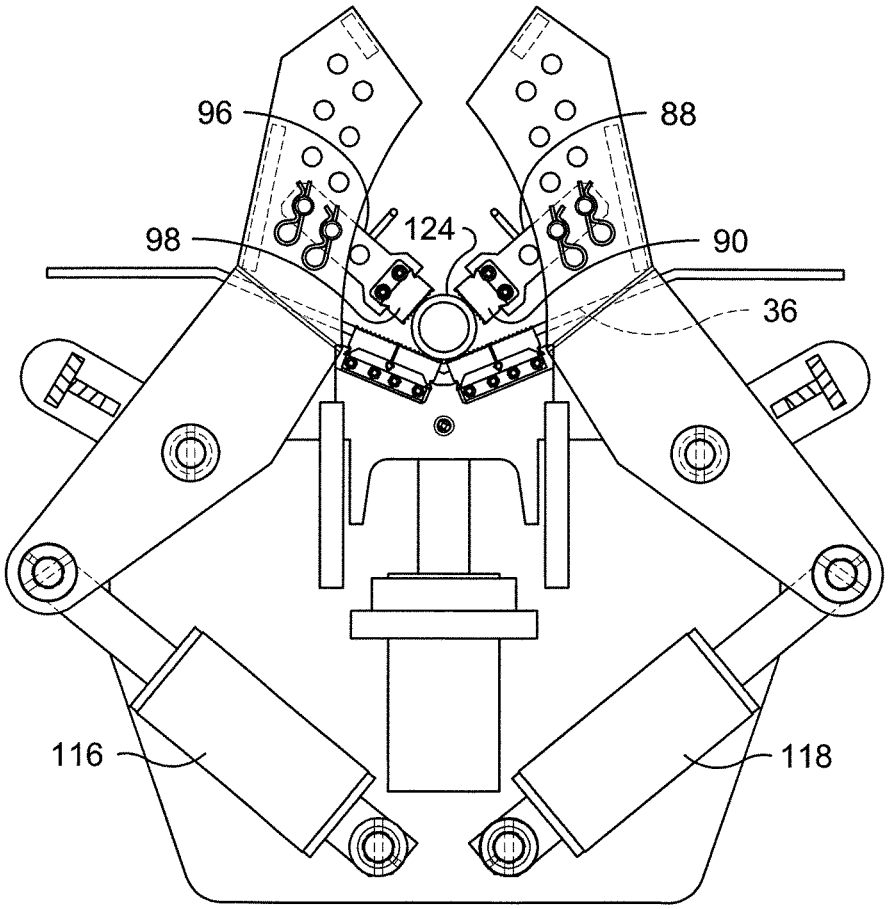
FIG. 5 is an elevational view of the pipe gripping mechanism as in FIG. 4, but showing the pivoted arms in a closed condition.

As shown in FIG. 5, when the pistons of actuators 116 and 118 are extended, the jaws 90 and 98 are moved toward each other and toward the centering jaw to grip a small diameter drill pipe 124. The same jaw holders and jaws shown in FIGS. 3, 4 and 5 can be disengaged from the lowermost mounting holes on the arms and remounted using other mounting holes to accommodate larger drill pipes. By way of example, drill pipes having a diameter as small as 4 inches can be accommodated in a typical gripping mechanism in accordance with the invention when the jaws are mounted in the lowermost mounting holes, and well casing having a diameter as large as 24 inches can be accommodated when the same jaws are mounted in the uppermost mounting holes. In a typical gripping mechanism in accordance with the invention, the ranges of drill pipe diameters that can be accommodated are 4-10 inches when the jaw holders are mounted in the mounting holes closest to the arm pivot axes, 10-14 inches for the next set of mounting holes, 14-20 inches for the next set of mounting holes and 20-24 inches for the outermost set of mounting holes. The jaw holders can be easily removed and remounted manually, using cylindrical mounting pins and cotter pins.

As can be seen from FIG. 5, the pipe is gripped securely because jaws 90, 98 and the centering jaw grip the pipe at locations adjacent the apices of an imaginary triangle containing the pipe's axis. The same holds true for any pipe size within the ranges accommodated by the pipe gripping mechanism.

A principal advantage of the invention is that it eliminates the need for a drill operator to have a large number of expensive jaws on hand to accommodate different sizes of drill pipe. Moreover, the jaws for attachment to the arms of the gripping mechanism can be identical to each other. The invention also allows for easy and rapid adjustment of the pipe size capability of the gripping mechanism.

Well casing, which has a large diameter but generally has a wall thickness less than that of a drill pipe, is susceptible to crushing when a large clamping force is applied to it. Another advantage of the invention is that, because the jaws on the pivoted arms are positioned farther from the pivot axes of the arms when large diameter well casing is being handled, the reduced mechanical advantage reduces the gripping force applied to the casing.

The embodiment described above is an example of a preferred drill pipe handling system and gripping mechanism. Numerous modifications can be made to the handling system and gripping mechanism. For example, many of the advantages of a gripping mechanism with arms having repositionable jaws as described above can be realized in an apparatus in which the gripping mechanism is mounted on an articulated arm used for moving a length of drill pipe from a supply rack to a drilling mast, i.e., a loading device without the V-shaped tray as shown in FIGS. 1 and 2. Other jaw-mounting means such as bolts, and other jaw mounting plate configurations and clamping arm configurations can also be used.

The invention claimed is:

1. A drill pipe handling apparatus comprising:

a pipe gripping mechanism, said pipe gripping mechanism comprising:

a support frame;

first and second arms connected to said support frame and movable relative to said support frame respectively about first and second pivot axes;

a first actuator connected to said first arm and said support frame for moving said first arm about said first pivot axis;

a second actuator connected to said second arm and said support frame for moving said second arm about said second pivot axis;

a first jaw connectible to said first arm at any selected one of plural distances from said first pivot axis and connected to said first arm at one of said plural distances;

a second jaw connectible to said second arm at any selected one of said plural distances from said second pivot axis and connected to said second arm at said one of said plural distances; and a third jaw connected to said support frame;

wherein said first and second laws are connected to said first and second arms at equal distances from the pivot axes of the respective arms, and the first, second and third jaws are positioned in relation to one another so that a cylindrical pipe within a range of pipe diameters can be gripped by contact, by said first, second and third jaws, with the exterior surface of said cylindrical pipe respectively at locations adjacent the three apices of a triangle containing the pipe axis, said ranges of pipe diameters being different for each of said plural distance; and wherein said third jaw is movable along a line extending between said first and second jaws.

2. A drill pipe handling apparatus according to claim 1, including an actuator for moving said third jaw along said line extending between said first and second jaws.

3. A drill pipe handling apparatus according to claim 1, in which said first and second pivot axes lie parallel to each other in a common imaginary plane, and in which said third jaw is movable relative to said support frame, along said line extending between said first and second jaws, in a direction perpendicular to said imaginary plane.

4. A drill pipe handling apparatus according to claim 1, in which said first and second pivot axes lie parallel to each other in a common imaginary plane, relative to said support frame, and including an actuator for moving said third jaw, along said line extending between said first and second jaws, in a direction perpendicular to said imaginary plane.

5. A drill pipe handling apparatus comprising:

a pipe gripping mechanism, said pipe gripping mechanism comprising:

a support frame;

first and second arms connected to said support frame and movable relative to said support frame respectively about first and second pivot axes;

a first actuator connected to said first arm and said support frame for moving said first arm about said first pivot axis;

a second actuator connected to said second arm and said support frame for moving said second arm about said second pivot axis;

a first jaw connectible to said first arm at any selected one of plural distances from said first pivot axis and connected to said first arm at one of said plural distances;

a second jaw connectible to said second arm at any selected one of said plural distances from said second pivot axis and connected to said second arm at said one of said plural distances; and a third jaw connected to said support frame;

wherein said first and second jaws are connected to said first and second arms at equal distances from the pivot axes of the respective arms, and the first, second and third jaws are positioned in relation to one another so that a cylindrical pipe within a range of pipe diameters can be gripped by contact, by said first, second and third jaws, with the exterior surface of said cylindrical pipe respectively at locations adjacent the three apices of a triangle containing the pipe axis, said ranges of pipe diameters being different for each of said plural distances; and wherein each of said arms is formed with plural sets of pin-receiving mounting holes, said sets of mounting holes being at different distances from the pivot axis of the arm in which they are formed, in which the first jaw includes a jaw holder having a first set of mounting holes formed therein and is mounted on the first arm by pins extending through said first set of mounting holes and through one of said sets of pin-receiving mounting holes formed in the first arm, and in which the second jaw includes a jaw holder having a second set of mounting holes formed therein and is mounted on the second arm by pins extending through said second set of mounting holes and through one of said sets of pin-receiving mounting holes formed in the second arm.

6. A drill pipe handling apparatus according to claim 5, in which the number of said sets of mounting holes is at least four.

7. A drill pipe handling apparatus comprising:

a pipe gripping mechanism, said pipe gripping mechanism comprising:

a support frame;

first and second arms connected to said support frame and movable relative to said support frame respectively about first and second pivot axes;

a first actuator connected to said first arm and said support frame for moving said first arm about said first pivot axis;

a second actuator connected to said second arm and said support frame for moving said second arm about said second pivot axis;

a first jaw connectible to said first arm at any selected one of plural distances from said first pivot axis and connected to said first arm at one of said plural distances;

a second jaw connectible to said second arm at any selected one of said plural distances from said second pivot axis and connected to said second arm at said one of said plural distances; and a third jaw connected to said support frame;

wherein said first and second laws are connected to said first and second arms at equal distances from the pivot axes of the respective arms, and the first, second and third jaws are positioned in relation to one another so that a cylindrical pipe within a range of pipe diameters can be gripped by contact, by said first, second and third jaws, with the exterior surface of said cylindrical pipe respectively at locations adjacent the three apices of a triangle containing the pipe axis, said ranges of pipe diameters being different for each of said plural distances;

wherein said drill pipe handling apparatus includes an elongated support having first and second opposite ends, said support being pivoted adjacent said first end about a horizontal pivot axis for movement of the elongated support in a vertical plane whereby the second end of the support can be raised and lowered, a pipe-supporting tray mounted on said support and slidable along said support in the direction of elongation of the support; and wherein said support frame of the pipe gripping mechanism is mounted adjacent said second end of the support, and said jaws are positioned to receive a length of drill pipe resting on said pipe-supporting tray.

8. A drill pipe handling apparatus according to claim 7, wherein said second end of the support is located between said first end of the support and said pipe gripping mechanism, and said pipe gripping mechanism is mounted for movement along said direction of elongation of the support.

* * * * *